US005303854A

United States Patent [19]

Cater

[11] Patent Number: 5,303,854

[45] Date of Patent: Apr. 19, 1994

[54] PHARMACEUTICAL PUMP DISPENSER HAVING HYDRAULICALLY CLOSED OUTLET PORT

[75] Inventor: Miro S. Cater, Newtown, Conn.

[73] Assignee: Spruhventile GmbH, Wyhl am Kaiser Stuhl, Fed. Rep. of Germany

[21] Appl. No.: 27,660

[22] Filed: Mar. 8, 1993

[51] Int. Cl.[5] ..... B65D 88/54

[52] U.S. Cl. ..... 222/321; 222/341

[58] Field of Search ..... 222/321, 341, 378, 383, 222/385; 417/544, 510; 239/333

[56] References Cited

U.S. PATENT DOCUMENTS

| | | | |
|---|---|---|---|
| 5,038,965 | 8/1991 | Cater | 222/321 X |
| 5,064,105 | 11/1991 | Montaner | 222/321 |
| 5,083,682 | 1/1992 | Cater | 222/321 |
| 5,147,073 | 9/1992 | Cater | 222/321 |

*Primary Examiner*—Gregory L. Huson

[57] ABSTRACT

A finger actuated pump dispenser employs a first upper hollow vertical cylinder with a first diameter and open upper and lower ends and a second lower hollow vertical cylinder with a second and smaller diameter and a closed lower end with a central opening. The lower end of the first cylinder is joined to an open upper end of the second cylinder. The inner wall of the second cylinder has a horizontal annular recess. A first vertical hollow piston has openings in top and bottom ends and extendings slidably above and within first cylinder. The first piston has an enlargement intermediate its ends peripherally engaging and defining a first unbroken seal with the inner surface of the first cylinder. A second vertical piston has a central vertical bore extending therethrough and is disposed slidably within the second cylinder. The second piston peripherally engages and defines a second seal with the inner surface of the second cylinder. The second seal is unbroken except when the second piston is aligned with and spaced from the annular recess. A vertical stem is disposed slidably within the first piston with an outwardly extending central horizontal flange secured thereto intermediate its ends. The bottom opening of the first piston engages and defines a third seal with the flange. The third seal is broken when the bottom opening of the first piston is separated from the flange. A portion of the stem below the flange extends vertically and slidably downwards through the central bore of the second piston. The portion engages and defines a fourth unbroken seal with said bore. A spring extends within the second cylinder between its lower end and the lower end of the second piston.

8 Claims, 3 Drawing Sheets

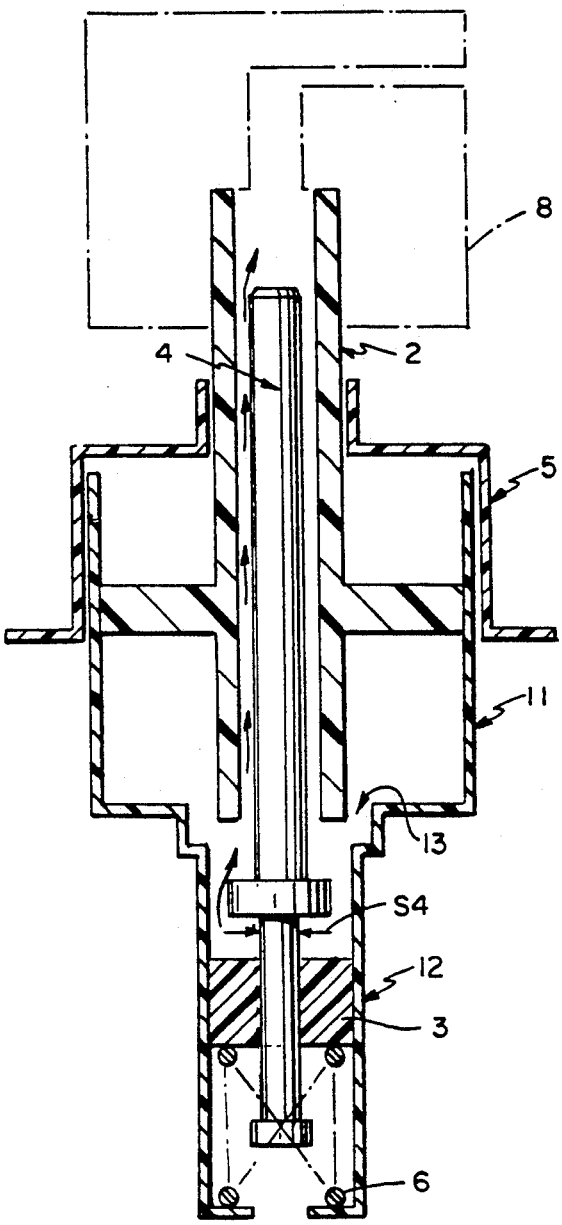
FIG. 3
FIG. 5
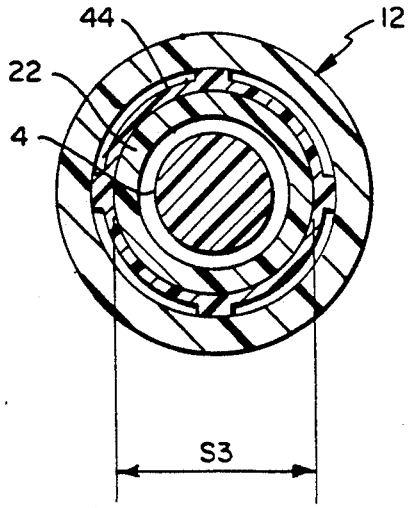
FIG. 6
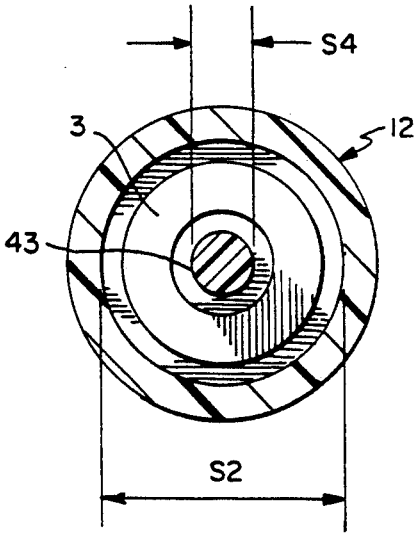

PHARMACEUTICAL PUMP DISPENSER HAVING HYDRAULICALLY CLOSED OUTLET PORT

BACKGROUND OF THE INVENTION

U.S. Pat. Nos. 5,038,965 and 5,147,073 disclose fluid pump dispensers for pharmaceutical applications wherein fluids are discharged at a predetermined pressure and wherein a predetermined dosage is delivered regardless of the method of actuation. These dispensers have outlet ports through which the fluid is discharged and have inlet ports through which the fluid to be dispensed is fed into the dispensers from a container supplying the fluid. To ensure delivery of a predetermined dosage, a pharmaceutical dispenser is designed so that its exit port is held closed during actuation until a predetermined point on the down stroke is reached. At this point the outlet port is opened and the discharge of the predetermined dosage is initiated. The dispensers disclosed in the above identified patents employ an additional spring, other than the conventional return spring, which is used to hold the outlet port closed during part of the actuation. The elimination of the additional spring is most desirable, since such simplification decreases manufacturing difficulties, thus increasing performance and quality of the product.

The present invention is directed toward pharmaceutical dispensers which eliminate the additional spring and enable the outlet port to be held closed solely by the use of hydraulic forces, thus resulting in reduction of manufacturing difficulties and in enhanced performance.

SUMMARY OF THE INVENTION

Accordingly, it is an object of the present invention to provide a new and improved pharmaceutical dispenser wherein the use of an additional spring is eliminated.

Another object is to provide a new and improved pharmaceutical dispenser of the character indicated wherein the outlet port is held closed during at least a portion of actuation solely by the use of hydraulic forces.

Still another object is to provide a new and improved pharmaceutical dispenser of the character indicated which is characterized by reduced manufacturing complexity and enhanced performances.

These and other objects and advantages of this invention will either be explained or will become apparent hereinafter.

In accordance with the principles of this invention, a finger actuated pump dispenser employs a first upper hollow vertical cylinder with a first diameter and open upper and lower ends and a second lower hollow vertical cylinder with a second and smaller diameter and a closed lower end with a central opening. The lower end of the first cylinder is joined to an open upper end of the second cylinder. The inner wall of the second cylinder has a horizontal annular recess.

A first vertical hollow piston has openings in top and bottom ends and extends slidably above and within first cylinder. The first piston has an enlargement intermediate its ends peripherally engaging and defining a first unbroken seal with the inner surface of the first cylinder.

A second vertical piston has a central vertical bore extending therethrough and disposed slidably within the second cylinder. The second piston peripherally engages and defines a second seal with the inner surface of the second cylinder. The second seal is unbroken except when the second piston is aligned with and spaced from the annular recess.

A vertical stem is disposed slidably within the first piston with an outwardly extending central horizontal flange secured thereto intermediate its ends. The bottom opening of the first piston engages and defines a third seal with the flange. The third seal is unbroken except when the bottom opening of the first piston is separated from the flange. A portion of the stem below the flange extends slidably downwards through the central bore of the second piston. The portion engages and defines a fourth unbroken seal with the inner surface of said bore.

A spring extends within the second cylinder between its lower end and the lower end of the second piston.

The bottom opening in the first piston cooperates with the flange to define an outlet port. The outlet port is closed when the bottom opening in the first piston engages the flange and is open when the bottom opening is spaced from the flange.

The second piston cooperates with the horizontal recess in the inner wall of the second cylinder to define an inlet port. The inlet port is closed when the second periphery of the inner piston engages and seals against the inner surface of the second cylinder and is open when the second periphery is aligned with and spaced from the first recess.

In use, a collar with a central opening encloses the upper end of the first cylinder. The first piston extends upwardly therethrough. An actuator with a discharge path and an exit opening is disposed above and engages the top of the outer piston, with the top opening in the first piston communicating with the discharge path in the actuator.

Since this dispenser is a pharmaceutical dispenser, it must deliver the same accurate dosage during each complete cycle of operation, that is the completion both of the downstroke and the upstroke. This requirement can only be obtained when the user maintains pressure on the actuator during the entire cycle. If the user releases the pressure during the downstroke, the downstroke will be aborted without any discharge.

After the dispenser has been primed, the first cylinder is filled with fluid drawn through the central opening in the lower end of the second cylinder from a container of fluid to which the dispenser is detachably secured. The outlet port is closed and the inlet port is open.

Upon actuation by a user exerting pressure on the actuator, the first piston, stem and second piston travel downward with the outlet port remaining closed. Once the second piston moves downwardly out of alignment with the first recess, the inlet port is closed.

As the first piston, stem and second piston continue to travel downward, the fluid, being incompressible, is displaced from the larger first upper cylinder into the smaller second lower cylinder. This displacement forces the second piston to move downwardly along the stem.

As will be explained in more detail hereinafter, the fluid in the cylinders is pressurized in proportion to the upward force of the spring and the area of the second piston which is exposed to the fluid bearing downwardly upon it. This pressure exerts an upward force on the central stem in proportion to the area defined by the difference between the area of the second seal and the area of the fourth seal and maintains the outlet port closed.

The second piston continues to move downward until its bottom end is aligned with the lower end of the stem. The stem and second piston then move downwardly together, moving the flange away from the bottom opening in the first piston. This downward motion opens the outlet port and the fluid in the second cylinder is discharged therethrough and upwardly in the space between the stem and the first piston, and a through and is discharged through the actuator.

Once the outlet port is opened, because of the change in pressure, the second piston travels upwardly on the stem. Moreover, as the fluid discharge begins, a downward force is applied to the stem in proportion to the area of the fourth seal and forces it downwardly away from the first piston during the entire period of discharge.

As the discharge is completed, with the entire fluid contents being expelled, the second piston engages the flange and moves it upward into engagement with the bottom end of the first piston, closing the outlet port. The spring force then moves the second piston, the first piston and the stem into the original position. As the second piston moves upward into alignment with the first horizontal recess, the inlet port is open. At this point, a reduction of pressure draws the fluid through the inlet port into the upper cylinder.

BRIEF DESCRIPTION OF THE DRAWINGS

FIG. 3 is a view of the embodiment of FIG. 1 shown during a discharge.

FIG. 5 is a detail cross section taken along line A—A in FIG. 5.

FIG. 6 is a detail cross section taken along line B—B in FIG. 5.

DETAILED DESCRIPTION OF PREFERRED EMBODIMENTS

Figure 1:
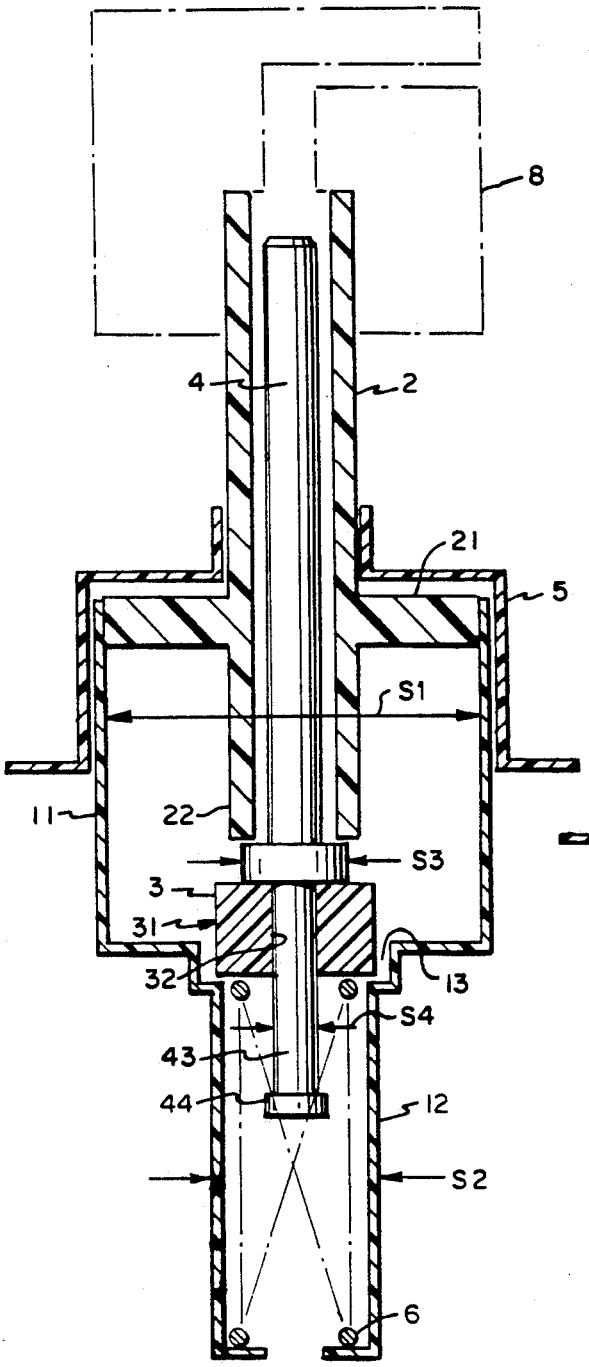
FIG. 1 shows a vertical cross sectional view, in simplified diagrammatic form, of a dispenser in accordance with the invention as shown in rest position.
Figure 2:
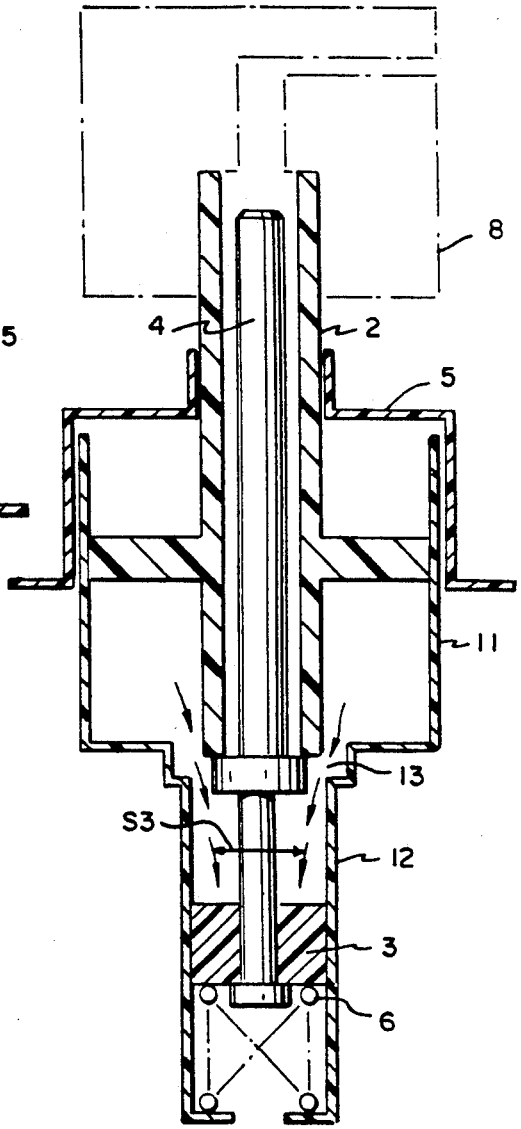
FIG. 2 is a view of the embodiment of FIG. 1 shown during a downstroke.

Referring first to FIGS. 1-3, a finger actuated pump dispenser employs a first upper hollow vertical cylinder 11 with a first diameter and open upper and lower ends and a second lower hollow vertical cylinder 12 with a second and smaller diameter and a closed lower end with a central opening. The lower end of the first cylinder is joined to an open upper end of the second cylinder. The inner wall of the second cylinder has a horizontal annular recess 13.

A first vertical hollow piston 2 having a top opening 25 and a bottom opening 24 extends slidably above and within first cylinder. The first piston has an enlargement 21 intermediate its ends peripherally engaging and defining a first unbroken seal S1 with the inner surface of the first cylinder.

A second vertical piston 3 having a central vertical bore defining an inner periphery 32 extending therethrough is disposed slidably within the second cylinder. The outer periphery 31 of the second piston peripherally engages and defines a second seal S2 with the inner surface of the second cylinder, the second seal being unbroken except when the second piston is aligned with and spaced from the annular recess.

A vertical stem 4 disposed slidably within the first piston and is spaced therefrom. The stem has an outwardly extending central horizontal flange 42 secured thereto intermediate its ends, the bottom opening of the first piston engaging and defining a third seal S3 with the flange. The third seal is broken when the bottom opening of the first piston is separated from the flange.

A portion of the stem extends below the flange, defining a shaft 43 which extends slidably downwards through the central bore of the inner piston and has a bottom end with a flare or rim 44. The flare or rim has an outer diameter which is larger than the inner periphery of the bore and prevents the second piston from becoming completely separated from the shaft 43. The shaft 43 engages and defines a fourth seal S4 with the inner surface of said bore.

A spring 6 extends within the second cylinder between its lower end and the lower end of the second piston. A collar 5 closes off the top of the upper cylinder and is provided with a central opening through which the first piston extends. The collar is usually surrounded by a cup 7 which attaches the dispenser to a container. The top opening in the first piston communicates with the discharge path of the top mounted actuator 8.

As will be explained in more detail below, the diameter of the first seal S1 is larger than the diameter of the second seal S2, the diameter of S2 is larger than the diameter of the third seal S3, and the diameter of S3 is larger than the diameter of the fourth seal S4.

Initially, the upper cylinder is filled with fluid. When the actuator is depressed, the first piston, stem and second piston travel downward. When the second piston passes the recess, the inlet port is closed. Since the fluid is incompressible, as the first piston, stem and second piston continue to travel downward, the fluid is displaced from the larger upper cylinder 11 into the lower smaller cylinder, forcing the second piston 3 to move downwardly along the shaft 43.

The fluid in the chamber is pressurized at pressure P in proportion to the force Fs of the spring and the area of the second piston which is exposed to the fluid bearing down upon it. This area is defined as the difference between the area A of seal S2 and and the area D of seal S4. Hence, $P=Fs/[A-D]$.

While the second piston is free to move downwardly along the shaft 43, this pressure P exerts an upward force Fu on the flange which is equal to the product of P and the area C of seal S3 less the area D of seal S4. Hence $Fu=P/[C-D]$. This force maintains the outlet port closed.

The displacement of the second piston continues until the lower end of the second piston engages the flare or rim 44 at the bottom of shaft 43. Further displacement of fluid from the upper cylinder to the lower cylinder forces the stem and engaged second piston to move downwardly together. This action breaks the third seal S3, opening the outlet port and causing the fluid to pass through the outlet port, upwardly in the space between the first piston and the stem, out of the top opening 25 in the first piston and discharge through the actuator.

When the lower end of the second piston engages the flare, the down pressure of the fluid P increases relative to the difference between the area A of seal S2 and the area C of seal S3 so that $P=Fs/[A-C]$, resulting in an increase in the actuating force.

Once the outlet port opens, the actuating force is reduced by a decrease in pressure to $P=Fs/C$. This sudden decrease in pressure makes it impossible for the user to interrupt the actuation once discharge has begun. The pressure reverses its force on the stem. Since the entire stem is now surrounded by fluid, except for the portion that protrudes within the second piston, the stem is forced away from the first portion with a force F equal to the product of P and the area D of the fourth seal so that $F=PD$. This downward force maintains the outlet port open throughout the discharge.

It will be apparent that the period of time between the beginning of the downstroke and the initial start of the discharge, defined as the delay period, is determined by the time required for the lower end of the second piston to engage the flare at the bottom of the shaft, since this engagement causes the outlet port to open, thus initiating the discharge.

The duration of the delay period increases or decreases as the length of the shaft 43 is increased or decreased. When the shaft length is reduced, the lower end of the second piston engages the flare during an earlier portion of the downstroke, the outlet port is opened correspondingly early and the duration of the delay period is reduced. As the shaft length is increased, the outlet port is opened correspondingly later during the downstroke and the duration of the delay period is increased. The length of the shaft can be so chosen that the entire contents of the upper cylinder can be displaced into the lower cylinder prior to opening the port. In this case, the duration of the delay period is increased to a maximum and the discharge rate is controlled solely by the spring and the pump geometry.

Once the outlet port is opened, the second piston travels upwardly along the shaft, forcing complete discharge of the fluid. Once the entire contents of fluid in the cylinders has been discharged, the second piston engages the flange, pushing the flange into engagement with the bottom opening in the first piston and closing the outlet port. When the finger pressure on the actuator is removed, the spring moves both pistons and the stem upward. As the second piston moves into engagement with the recess, the inlet port is opened, and the fluid is forced into the first cylinder.

Figure 4:
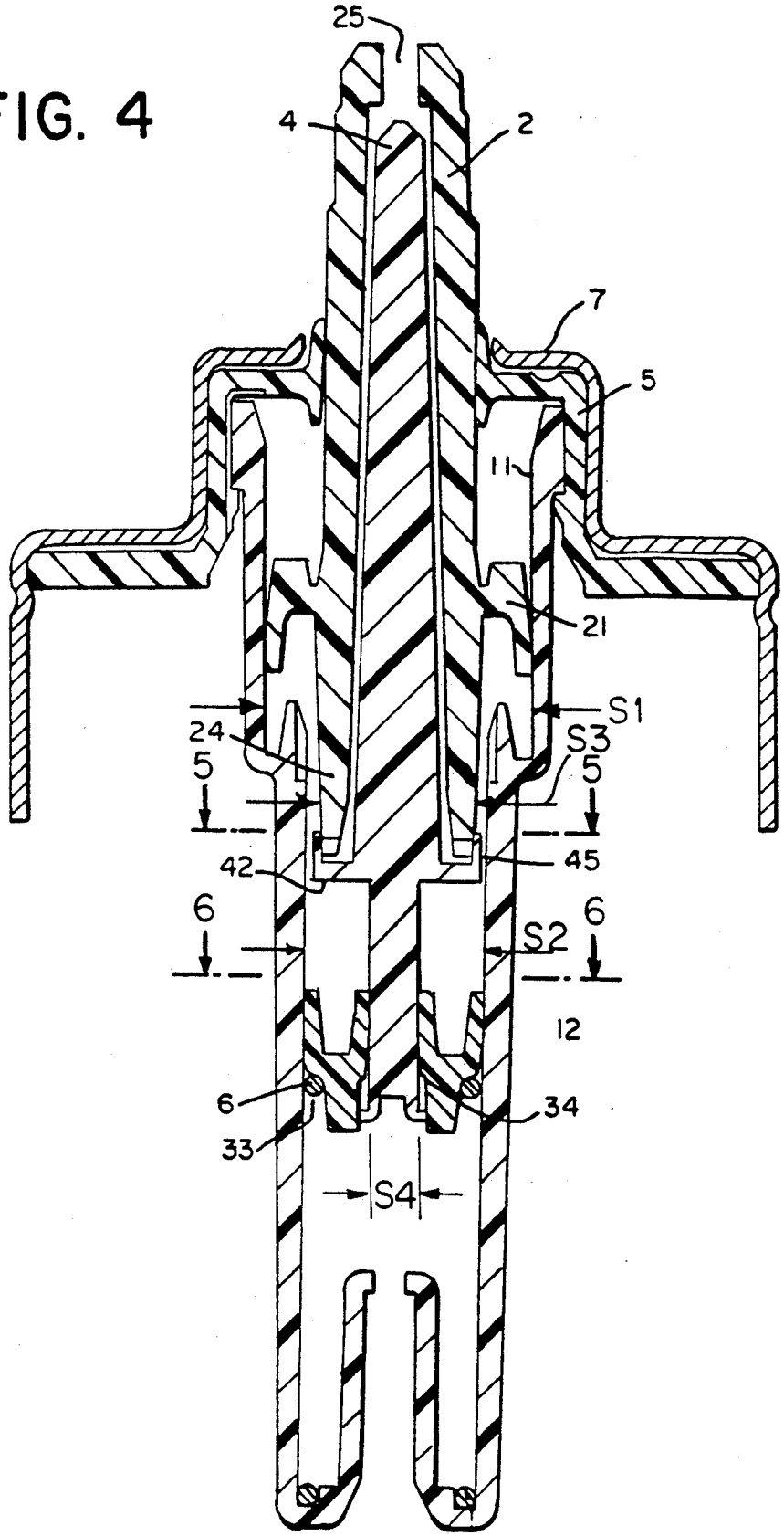
FIG. 4 is a more detailed vertical cross sectional view of a preferred embodiment of the invention as shown in during a downstroke.

The dispenser shown in FIGS. 4–6 has the same components as the dispenser of FIGS. 1–3; identifies these components by the same reference numbers. However, for ease of manufacture and assembly, the structure of the dispenser of FIGS. 4–7 is slightly modified as explained below.

Referring now to FIGS. 4–6, second piston 3 has a spring seat 33 for receiving the upper end of spring 6. Piston 3 also a ledge 34 which is engaged by the rim 44 when the piston and shaft 43 move downward together. The ledge and rim are free to separate when the piston moves upwardly with respect to the shaft.

The flange 42 forms a cup 45 which is engaged by the open bottom end of piston 24 in such a manner as to engage both the flat horizontal surface and the vertical sides of the cup 45.

The lower end 48 of cylinder 12 has an opening 50 recessed upwardly via a channel 52 which can receive a dip tube when necessary. The lower end of cylinder 11 is connected to the upper end of cylinder 12 by a circular groove 52 which can receive the lower end of the first piston 2.

The dispensers shown in FIGS. 4–6 and in FIGS. 1–3 function in exactly the same manner and use the same four seals having the same diametrical relationships.

While the invention has been described with particular reference to the drawings and detailed description, the protection sought is to be limited only by the terms of the claims which follow.

What is claimed is:

1. A finger actuated pump dispenser comprising:

a first upper hollow vertical cylinder with a first diameter and open upper and lower ends, a second lower hollow vertical cylinder with a second and smaller diameter and a closed lower end with a central opening, the lower end of the first cylinder being joined to an open upper end of the second cylinder, the inner wall of the second cylinder having an enlarged horizontal annular recess at the junction of the first and second cylinders;

a first vertical hollow piston having openings in top and bottom ends and extending slidably above and within first cylinder, the first piston having an enlargement intermediate its ends peripherally engaging and defining a first unbroken seal with the inner surface of the first cylinder;

a second vertical piston having a central vertical bore extending therethrough and disposed slidably within the second cylinder, the second piston peripherally engaging and defining a second seal with the inner surface of the second cylinder, the second seal being unbroken except when the second piston is aligned with and spaced from the annular recess;

a vertical stem disposed slidably within the first piston with an outwardly extending central horizontal flange secured thereto intermediate its ends, the bottom opening of the first piston engaging and defining a third seal with the flange, the third seal being broken when the bottom opening of the first piston is separated from the flange, a portion of the stem below the flange extending vertically and slidably downwards through the central bore of the second piston, the portion engaging and defining a fourth unbroken seal with said bore; and a spring extending within the second cylinder between its lower end and the lower end of the second piston.

2. The dispenser of claim 1 wherein said stem portion is a shaft.

3. The dispenser of claim 2 wherein the shaft has a lower end having a diameter larger than the diameter of the bore.

4. The dispenser of claim 3 wherein the third seal is broken at a point during the downstroke when the lower end of the shaft engages the lower end of the second piston, the period of time between the time of initiation of the downstroke and the time at which the third seal is broken being defined as the delay period, the delay period increasing with increasing length of the shaft and decreasing with decreasing length of the shaft.

5. The dispenser of claim 1 wherein the diameter of the first seal is larger than that of the second second seal, the diameter of the second seal is larger than that of the third seal, and the diameter of the third seal is larger than that of the fourth seal.

6. A finger actuated pump dispenser comprising:

a first upper hollow vertical cylinder with a first diameter and open upper and lower ends;

a second lower hollow vertical cylinder with a second and smaller diameter and a closed lower end with a central opening, the lower end of the first cylinder being joined to an open upper end of the second cylinder, the inner wall of the second cylinder having an enlarged horizontal annular recess at the junction of the first and second cylinders;

a first vertical hollow piston having openings in top and bottom ends and extending slidably above and within first cylinder, the first piston having an enlargement intermediate its ends peripherally engaging and defining a first unbroken seal with the inner surface of the first cylinder, the first seal having a given diameter;

a second vertical piston having a central vertical bore extending therethrough and disposed slidably within the second cylinder, the second piston peripherally engaging and defining a second seal with the inner surface of the second cylinder, the second seal having a diameter smaller than that of the first seal, the second seal being unbroken except when the second piston is aligned with and spaced from the annular recess;

a vertical stem disposed slidably within the first piston with an outwardly extending central horizontal flange secured thereto intermediate its ends, the bottom opening of the first piston engaging and defining a third seal with the flange, the third seal having a diameter smaller than that of the second seal, the third seal being broken when the bottom opening of the first piston is separated from the flange, a portion of the stem below the flange defining a shaft which extends vertically and slidably downwards through the central bore of the second piston, the shaft engaging and defining a fourth seal with said bore, the fourth seal having a diameter smaller than the diameter of the third seal, the shaft having a lower end with a diameter larger than the diameter of the bore; and a spring extending within the second cylinder between its lower end and the lower end of the second piston.

7. A finger actuated pump dispenser comprising:

a first upper hollow vertical cylinder with a first diameter and open upper and lower ends;

a second lower hollow vertical cylinder with a second and smaller diameter and a closed lower end with a central opening, the lower end of the first cylinder being joined to an open upper end of the second cylinder, the inner wall of the second cylinder having an enlarged horizontal annular recess at the junction of the first and second cylinders;

a first vertical hollow piston having openings in top and bottom ends and extending slidably above and within first cylinder, the first piston having an enlargement intermediate its ends which is in peripheral and sealingly engagement with the inner surface of the first cylinder;

a second vertical piston having a central vertical bore extending therethrough and disposed slidably within the second cylinder, the second piston being in peripheral and sealing engagement with the inner surface of the second cylinder except when the second piston is aligned with and spaced from the annular recess, the second piston and the recess defining an inlet port which is open when the piston is aligned with the recess and is otherwise closed;

a vertical stem disposed slidably within the first piston with an outwardly extending central horizontal flange secured thereto intermediate its ends, the bottom opening of the first piston being in sealing engagement with the flange except when the bottom opening of the first piston is separated from the flange, the bottom opening and the flange defining an outlet port which is open when the bottom opening is separated from the flange and is otherwise closed, a portion of the stem below the flange defining a shaft which extends vertically and slidably downwards through the central bore of the second piston in sealing engagement therewith, the shaft having a lower end with a diameter larger than the diameter of the bore; and a spring extending within the second cylinder between its lower end and the lower end of the second piston.

8. The dispenser of claim 7 wherein the outlet port is opened at a point during the downstroke when the lower end of the shaft engages the lower end of the second piston, the period of time between the time of initiation of the downstroke and the time at which the outlet port is opened being defined as the delay period, the delay period increasing with increasing length of the shaft and decreasing with decreasing length of the shaft.

* * * * *